US007242296B2

(12) United States Patent
Wang et al.

(10) Patent No.: US 7,242,296 B2
(45) Date of Patent: Jul. 10, 2007

(54) SAFE INTELLIGENT CONTAINER

(75) Inventors: Feng Wang, Guangdong (CN); Sidong He, Guangdong (CN)

(73) Assignee: China International Marine Containers (Group) Co., Ltd., Guangdong (CN)

( * ) Notice: Subject to any disclaimer, the term of this patent is extended or adjusted under 35 U.S.C. 154(b) by 252 days.

(21) Appl. No.: 10/942,859

(22) Filed: Sep. 17, 2004

(65) Prior Publication Data

US 2005/0061215 A1 Mar. 24, 2005

(30) Foreign Application Priority Data

Sep. 18, 2003 (CN) ..... 03 2 80711
Nov. 6, 2003 (CN) ..... 2003 2 0120805

(51) Int. Cl.
*G08B 13/08* (2006.01)

(52) U.S. Cl. ..... 340/545.6; 340/539.1

(58) Field of Classification Search ..... 340/545.6, 340/545.1, 539.1, 539.23, 431, 540, 686.3, 340/686.6; 343/878
See application file for complete search history.

(56) References Cited

U.S. PATENT DOCUMENTS

| | | | | |
|---|---|---|---|---|
| 4,750,197 | A * | 6/1988 | Denekamp et al. | 455/404.2 |
| 5,648,763 | A * | 7/1997 | Long | 340/825.49 |
| 6,281,793 | B1 * | 8/2001 | Haimovich et al. | 340/545.6 |
| 6,492,904 | B2 * | 12/2002 | Richards | 340/539.1 |
| 6,870,476 | B2 * | 3/2005 | Cockburn et al. | 340/545.6 |
| 2003/0164763 | A1 * | 9/2003 | Hisano et al. | 340/539.13 |
| 2004/0119588 | A1 * | 6/2004 | Marks | 340/539.1 |
| 2004/0189466 | A1 * | 9/2004 | Morales | 340/539.26 |
| 2005/0073406 | A1 * | 4/2005 | Easley et al. | 340/539.1 |

* cited by examiner

*Primary Examiner*—Thomas Mullen
(74) *Attorney, Agent, or Firm*—Rosenberg, Klein & Lee

(57) ABSTRACT

An intelligent transportation container is composed of a container body, door and electronic intelligent modules installed in the container. The electronic intelligent modules are installed in the door, and includes a door displacement transducer for monitoring the door movement and output of signals. The door has an aperture corresponding to the antenna on the electronic intelligent module, and the antenna passes through the antenna aperture and extends out of the container body. Relative movement of or between two doors, or the door movement relative to the doorcase, are used to monitor whether the door has been opened.

15 Claims, 3 Drawing Sheets

SAFE INTELLIGENT CONTAINER

FIELD OF THE INVENTION

This invention relates to transportation container, and relates particularly to a kind of intelligent container which can monitor whether the door is illegally opened.

BACKGROUND OF THE INVENTION

For existing intelligent containers, there is usually an electronic intelligent module featured with a magnetic function, timing, tracking and provides an electronic alarm installed on the upper part of the inner corner post at the door end of the container. The module is disposed in a trough formed by the inner and outer corner posts, its module arm is adhered to the inner corner post. There is a pressure transducer attached to the module, and the transducer has an antenna that cross the space between the door seal and the inner corner post and extends out of the container body. During transportation, the antenna, integrated with the containerized traffic monitoring system, performs timing, tracking and alarm functions for the container by radio signal transmission. Its working principal includes that when the door is normally closed, the sealing joint strip on the door leaf presses on the pressure transducer on the module. However, if the door is illegally opened, the sealing joint strip will be displaced from the pressure transducer with the door movement, and on the basis of pressure being relieved from the transducer, the module will output a signal that the door has been opened illegally. Later on, the module will perform relevant signal processing and output the alarm signal via the antenna, to timely inform the monitoring system staff so that they may adopt appropriate safe precautionary measures.

The existing intelligent containers often have the following problems:

1. The pressure transducer is adopted to perceive the pressure on the door sealing strip and detect whether the door is illegally opened, which is not very reliable. The first factor is that the hardness value of the door sealing strip of the container allows some alteration within a certain field, while different sealing strip products have different pressure within the same space between the door and the doorcase. In particular, the sealing strip on the module will be increasingly aged, and there is an obvious pressure difference between new sealing strips and old ones. The second factor is that, according to some experimental evidences, when the electronic intelligent module is installed onto a new container body and the door where the module is installed is open and is spaced about 50 mm away from the other door, the sealing strip will still press onto the pressure transducer of the module. However, on the basis of the pressure remaining on the sealing strip, the pressure transducer of the module won't output any signal of illegal door opening.

2. The mounting position of the module often allows the pressure transducer to be defeated. According to experimental evidences, if a thin plate or the like is inserted into the space between the sealing strip and the pressure transducer in advance of opening the door, the plate will maintain pressure on the pressure transducer. Thus, the door might be illegally opened, but without triggering the monitoring function of the electronic intelligent module.

3. The mounting position often brings about any sealing failure. The module arm cross the space between the door sealing strip and the inner corner post and lets the antenna extend out of the container body, which may cause the sealing strip to be distorted and fail to press on the doorcase tightly. Under such conditions, all of the weather tightness tests on the container body with the electronic intelligent module installed might fail and bring about water leakage, which often results in the container failing to meet the ISO standards.

4. A suite of intelligent devices can only detect whether a door is illegally opened, while either of the two doors might be independently and illegally opened, so it is required to installed two suites of intelligent devices at an increased cost.

5. The electronic intelligent module is installed onto the container by magnetic force. When the container travels back after being unloaded at some destination, the module is easily lost. That is to say, it is difficult to use the module to manage the container.

Thus, there is inconvenience and defects associated with the use of existing intelligent containers, so it is necessary to make some improvements therein.

SUMMARY OF THE INVENTION

The purpose of the invention is to offer an intelligent container that adopts a new monitor mechanism to monitor the door opening and closing operation.

To solve the above problems and achieve the above goal, this invention adopts a technical proposal as follows:

An intelligent container should include container body, door and electronic intelligent module installed on the container. The electronic intelligent module is installed on a door and has a door displacement transducer that observes and monitors the door displacement and outputs signals. There is an antenna aperture in the door at a location corresponding to the antenna on the electronic intelligent module, and the antenna passes through the aperture and extends out of the container body.

In this intelligent container, the electronic intelligent module is installed on a door. The door case displacement transducer on the electronic intelligent module is a door transducer facing towards the inner side of the container body. There is a door displacement transducer installed on the inside of the other door and adjacent to the module location. One end of a sensed element is connected to the other door, and the other end extends to the place where the door displacement transducer will locate when the door is normally closed.

In the intelligent container, the door displacement transducer is a proximity switch installed on a door. The proximity switch enters one state when the distance between itself and the door displacement transducer on the other door is less than a particular value, and it will enter into another state and output signals when the distance is greater than a certain value.

In the intelligent container, the door displacement transducer is a position switch installed on a door. The contactor of the position switch is open when the distance between the position switch and the door displacement transducer on the other door is less than particular value, and the contactor will be closed when the distance is greater than a certain value.

In the intelligent container, the door transducer is a pressure transducer installed on a door. The pressure transducer enters one state when the door displacement transducer on the other door is pressed down, and it will enter into another state and output signals when the elastic element of a baffle is displaced from the pressure transducer.

One end of the inner door displacement transducer is connected with the other door leaf, and the other end extends to the place where the baffle of the door displacement transducer will locate when the door is normally closed.

There is a U-shaped top door beam installed on a stile of the door adjacent to the other door, the open end of the U-shaped beam faces toward the inside part of the container body, and there is an antenna aperture in the stile. The electronic intelligent module is fixed into the trough in the U-shaped door closing beam, and the antenna on the electronic intelligent module passes through the antenna aperture in the top door beam and extends out of the container body.

An antenna sealing ring is installed between the inside surface of the antenna aperture and the external surface of the antenna, and the antenna sealing ring should be seamlessly combined with the antenna aperture and the contact surface of the antenna.

There is a locking bar transducer installed on the electronic intelligent module. There is a locking bar transducer sensed element installed on the cylindrical surface in the locking bar connected with the locking bar bracket. There is a locking bar transducer aperture in the door, which is opposite to the location of the locking bar transducer. The locking bar transducer on the electronic intelligent module extends out side of the container body through the locking bar transducer aperture. The locking bar transducer sensed element is displaced from the locking bar transducer when the door is normally closed. When the door is opened, the locking bar is rotated and the locking bar transducer sensed element will sweep across the locking bar transducer, resulting in the locking bar transducer outputting signals. After the locking bar transducer sensed element has approached the location of the locking bar transducer and the door is then closed normally, the locking bar transducer sensed element will be turned to some location being more distant from the locking bar transducer The locking bar transducer can be in the form of a proximity switch.

The locking bar transducer can be in the form of a position switch.

In the intelligent container, the locking bar transducer can be in the form of a pressure transducer. The contactor of the pressure transducer will be pressed by locking bar transducer sensed element when the distance between the pressure transducer and the locking bar transducer sensed element is less than particular value, and the sensed element will be separated from the locking bar transducer when the space is greater than a certain value.

In the intelligent container, there is a transducer sealing ring installed between the inside surface of the locking bar transducer aperture and the external surface of the locking bar transducer, and the transducer sealing ring is perfectly combined with the locking bar transducer aperture and the contact surface of locking bar transducer.

A danger sensitive module is installed in the intelligent container.

The danger sensitive module is installed in the U-shaped top door beam, close to the internal surface of the closed end of the top door beam. One end of the beam is connected to the electronic intelligent module and the other end extends in the opposite direction.

The electronic intelligent module and the danger sensitive module can be welded onto the steel angle on the top door beam, or bolted onto the top door beam, or fastened onto the top door beam with a hat-shaped mounting plate and common bolting device of the locking bar bracket, or soldered, bonded or magnetically attached onto the top door beam.

The door has a U-shaped top beam, and the open end of the U-shaped beam faces toward the inside of the container body. A doorcase proximity switch is installed on the upper flange of the top beam of the door. In addition, it is required to open an aperture in the doorcase and install the doorcase proximity switch sensed element at the location opposite to the proximity switch in the beam of the door. The doorcase proximity switch is connected to the electronic intelligent module via wiring. When the door is normally closed, and the distance between the proximity switch and the sensed element is less than a particular value, the proximity switch enters a state; and when the space is greater then a certain value, it will enter another state and output signals.

The doorcase proximity switch can be in the form of a capacitance type proximity switch, or induction type proximity switch or magnetic reed type proximity switch.

The technical scheme above utilizes the door displacement, like the relative displacement of the two door or the relative displacement of the door relative to the location of the doorcase, to monitor whether the door is illegally opened, which solves the problems occurring among the existing intelligent containers and brings simple structure and convenient installation for the container.

DESCRIPTION OF THE PREFERRED EMBODIMENT

Figure 1:
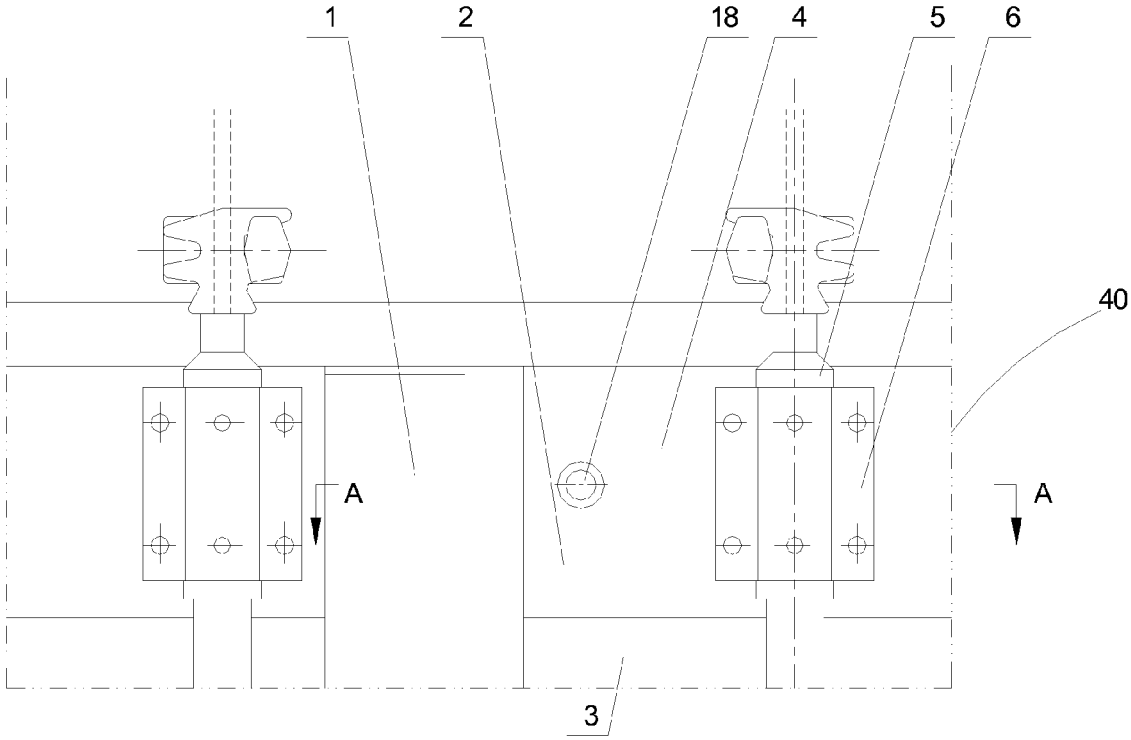
FIG. 1 is the partial front view of a container modified in accordance with the present invention.
Figure 2:
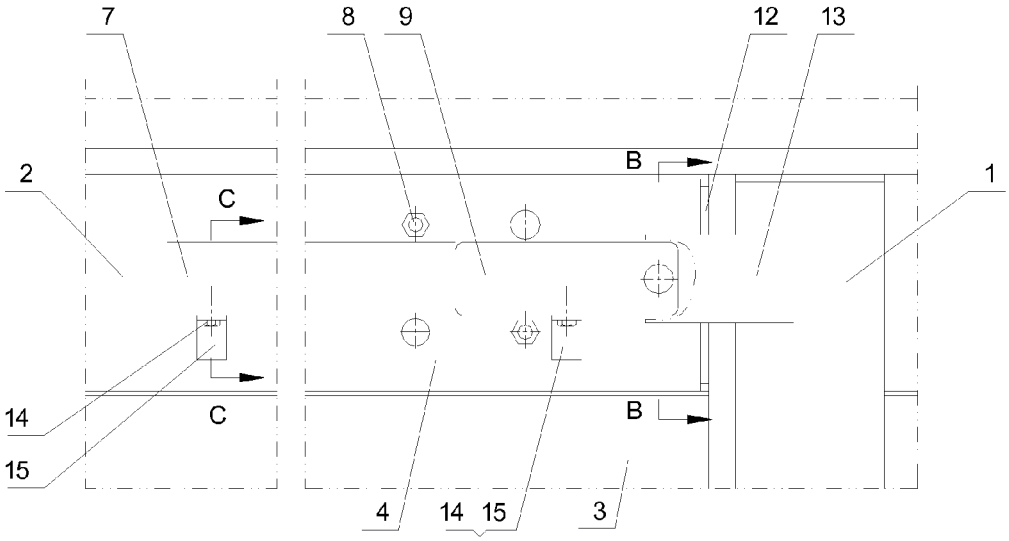
FIG. 2 is the partial rear view of FIG. 1.

The following section describes the invention on the basis of the attached drawing figures and the optimized examples:

FIG. 1 to FIG. 5 represents the structural relationship of an optimized example of the invention.

The U-shaped top beam 4 on the right door 2 extends from one end of the door to the door brim of the door. The open end of the U-shaped top door beam 4 faces toward the inside part of the container body 40. Its left end has an end surface closing plate 12 that is connected with the facade, upper and lower side surface of the top door beam by connecting methods such as soldering, bonding and riveting, etc. The upright door sill 3 joins and is soldered onto the underside plane of the top door beam 4 (the left upright door sill extends to the brim of the door and the top door beam joins and is soldered to the door upright sill, which is the fashionable structure of door), and there is an antenna aperture 20 in the facade of the top door beam 4 and adjacent to the left door 1.

The electronic intelligent module 9 is installed into the trough of top door beam 4 of the right door 2 and adjacent to the left door 1. The outer side on the left end of the module 9 has an antenna 18, and the antenna 18 can be soldered to the module 9 as a rigid coupling or plugged into the module 9 by a removable connection, such as by a screwed joint. The antenna 18 passes through the antenna aperture 20 and extends out of the container body 40. The space between the antenna 18 and the antenna aperture 20 usually includes a sealing ring 19, or the space between the module 9 and the facade of the top door beam 4 is provided with an edge sealing pad. When the surface of the antenna 18 is formed of elastic materials and the diameter of the antenna 18 matches the diameter of the antenna aperture 20 well, no sealing element is required. A door proximity switch 17 is installed inside the left end of the module 9, and its contactor extends out from the module 9. Of course, the switch 17 can also be installed as an independent piece connected with the module 9.

There is a baffle 13 installed inside the left door 1 and adjacent to the top door beam 4 of the right door 2. Its left end is connected to the left door 1 by soldering, riveting, bolting or bonding methods and its right end runs along the brim of the left door and extends outside. According to FIG. 3, when the door is normally closed, the extended end of the baffle 3 should be adjacent to the door proximity switch 17 and maintains a certain distance D1 from the switch 17. The distance D1 should be less than the operating distance enacted by the door proximity switch. According to FIG. 4, when the door is opened illegally, the right door 2 moves relative to the left door 1, and the distance D2 between the proximity switch 17 and the baffle 13 is greater than the operating distance D1, the door proximity switch 17 will send a signal, representing illegal opening of the door, to the electronic intelligent module 9. The module 9 will output an alarm via the antennae 18 and inform the working staff of a container safe transportation monitoring system to timely adopt safety precautions.

In normal operation, operators use some a specialized facility to communicate with and operate the electronic intelligent module 9 via its antenna 18.

The door proximity switch 17 is one of a capacitance type proximity switch, or induction type proximity switch or electromagnetic type proximity switch.

Figure 8:
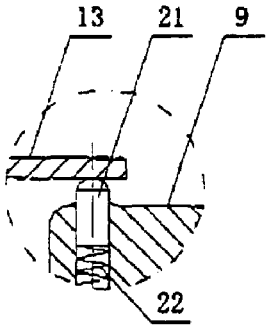
FIG. 8 is the Enlarged View of Part I in the other execution mode.

The door proximity switch 17 can also be replaced with a position switch. According to FIG. 8, when the door is normally closed, the elastic element 22 of the position switch will ensure its contactor 21 is pressed on the baffle 13, which operates the inner contactor of the position switch to open the switch. When the two doors have any illegal and relative displacement, the baffle 13 is separated from the contactor 21 of the position switch and the inner contactor of the position switch is closed, the position switch will output signals of illegally opening the door.

The door proximity switch 17 can also be changed to a pressure transducer. The baffle 13 and the contactor of the pressure transducer each include elastic elements. When the door is normally closed, the elastic element of the baffle 3 will be pressed onto the surface of the pressure transducer. In the event of any illegal and relative displacement of the two doors, and when the elastic element is separated from the surface of the pressure transducer, the pressure transducer will output a signal of illegally opening the door.

When the two doors both have a slight displacement at the same time relative to the doorcase, during an illegal opening thereof, the relative displacement between the two doors will be very slim. Thus, the door proximity switch 17 will be unable to detect that illegal opening action. In view of this, a locking bar proximity switch 26 is installed on the electronic intelligent module 9.

Figure 3:
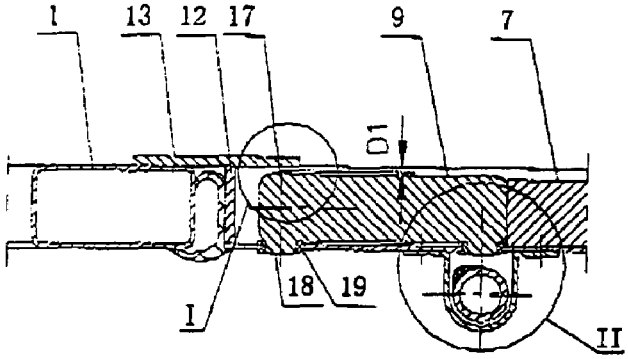
FIG. 3 is the A—A sectional view of FIG. 1.
Figure 5:
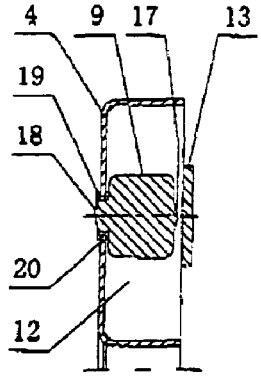
FIG. 5 is the B—B sectional view of FIG. 2.
Figure 4:
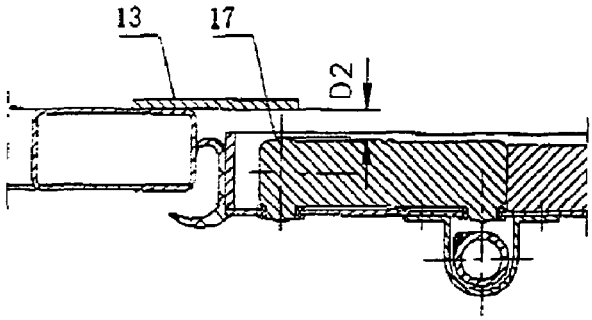
FIG. 4 is an illustration of FIG. 3 after relative displacement of the right door relative to the left door.
Figure 6:
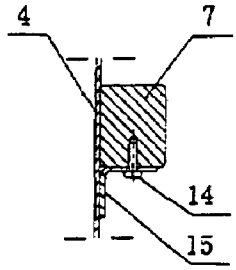
FIG. 6 is the C—C sectional view of FIG. 2.
Figure 7:
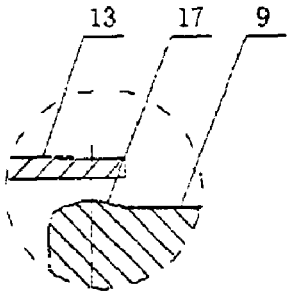
FIG. 7 is the enlarged view of Part I of FIG. 3.
Figure 9:
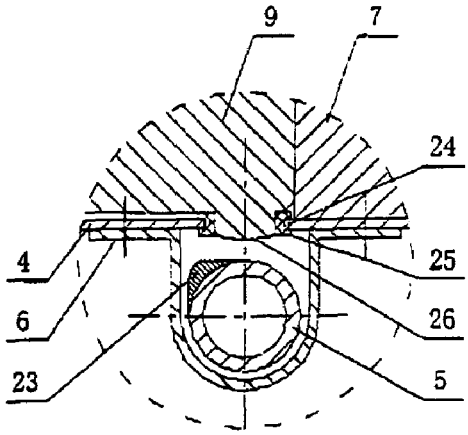
FIG. 9 is the enlarged view of Part II of FIG. 3.
Figure 10:
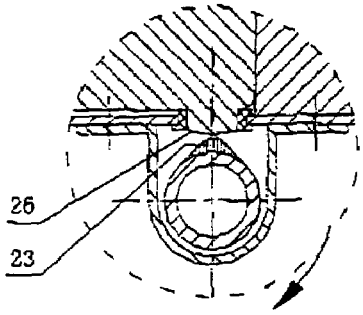
FIG. 10 is an illustration of FIG. 9 after the transducer sensed element 23 rotates to the place over the location of the transducer.

FIGS. 3, 9 and 10 show, a locking bar proximity switch 26 installed outside the right end of the electronic intelligent module 9 and adjacent to the locking bar 5 in an area corresponding to the locking bar bracket 6, and there is a locking bar proximity switch aperture 24 in the facade of the top door beam 4 at a position 4 opposite to the locking bar bracket 6. The locking bar proximity switch 26 passes through the locking bar proximity switch aperture 24 and extends out of the container body. A proximity switch sensing element 23 is fixed at the place opposite to the location of the locking bar proximity switch 26 on the cylindrical surface of the locking bar 5 at a location corresponding to the locking bar bracket 6, by a connection method such as of soldering, riveting and bonding. When the door is opened, the sensing element 23 will rotate with the locking bar 5 and sweeps across the proximity switch 26, which will turn the switch on and output signals.

The space between the proximity switch 26 and the proximity switch aperture 24 usually has a sealing ring 25 or a sealing pad inserted between the module 9 and the facade of the top door beam 4. When the surface of the proximity switch 26 is formed of elastic materials and there is a perfect combination of the proximity switch 26 and the proximity switch aperture 24, no sealing element is required.

The locking bar proximity switch 26 is one of a capacitance type proximity switch, or an induction type proximity switch or an electromagnetic type proximity switch.

Figure 11:
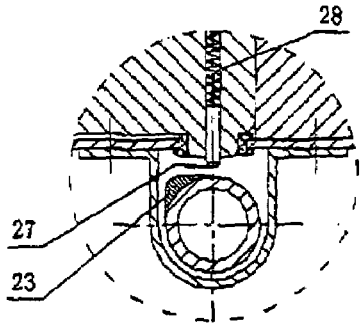
FIG. 11 is the enlarged view of Part II of FIG. 3 using a different type of transducer.
Figure 12:
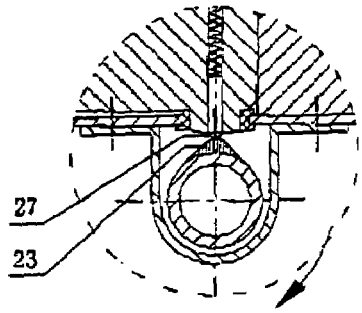
FIG. 12 is the illustration of FIG. 11 after the transducer sensed element 23 rotates to the place over the location of the transducer.
Figure 13:
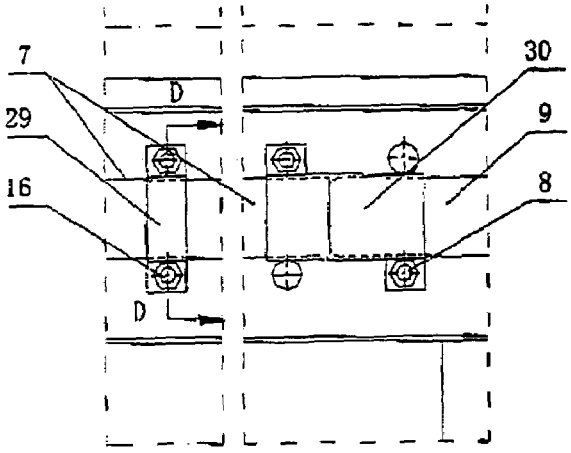
FIG. 13 is an illustration of the electronic intelligent module 9 and danger sensitive module 7 in FIG. 2 showing alternate mounting methods.
Figure 14:
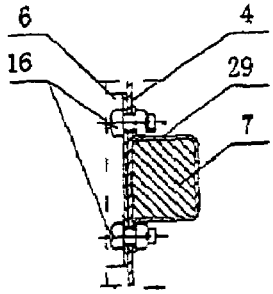
FIG. 14 is the D—D sectional view of FIG. 13.

The locking bar proximity switch 26 can also be replaced by a position switch. According to FIGS. 11 and 12, when the door is normally closed, the proximity switch sensing element 23 will be displaced from the proximity switch 26 and when the door is opened, the sensing element 23 will rotate with the locking bar 5, the position switch contactor 27 will move and the inner contactor that operates the position switch which will output a signal indicating opening of the door. After the sensing element 23 leaves from the position switch contactor 27, the contactor 27 will be restored to its original position under the influence of the elastic element 28. It is also allowable to have the sensing element 23 press in the position switch contactor 27 when the door is normally closed, and have the sensing element 23 displaced from the position switch contactor 27 when the door is opened.

A pressure transducer can also serve as the locking bar proximity switch 26. Then, the proximity switch sensing element 23 should be formed by an elastic element, and its installation location and working principles should be as same as those of the position switch.

For providing some device to detect whether there is any danger loaded into the container, a danger sensitive module 7 is installed in the top door beam 4, and one of its ends is connected to the electronic intelligent module 9 to transmit signals, while the other end extends in an opposing direction. One side of the danger sensitive module 7 is close to the internal surface of the facade of the top door beam 4.

FIGS. 2, 6, 13 and 14 respectively represent two fixing methods for the electronic intelligent module 9 and the danger sensitive module 7. One of the two is to fix steel angles 15 on the facade of the top door beam 4 by a soldering method, and using the bolts 14 fix the electronic intelligent module 9 and the danger sensitive module 7 thereto. The other method is to use hat-shaped mounting plates 29 and 30 secured by the common bolts 8 and 16 of the locking bar bracket 6 to fix the electronic intelligent module 9 and the danger sensitive module 7 onto the top door beam 4. Of course, it is also permitted to use one of soldering, bonding or magnetic force methods to fix the electronic intelligent module 9 and the danger sensitive module 7 onto the top door beam 4.

The electronic intelligent module 9 and the danger sensitive module 7 can also be installed on the inside sheet material of the door by appropriate means.

Figure 15:
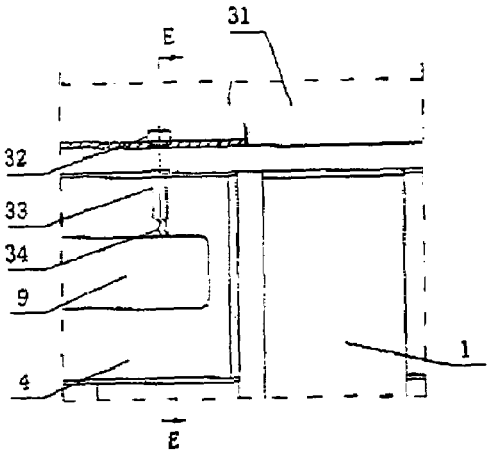
FIG. 15 is the structural representation of the mounting of the electronic intelligent module 9 with doorcase proximity switch 33 installed in FIG. 2.
Figure 16:
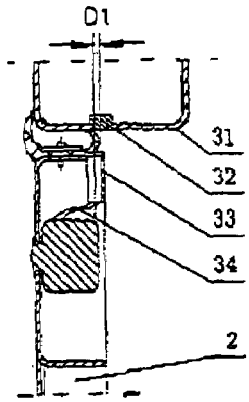
FIG. 16 is the E—E sectional view of FIG. 15.
Figure 17:
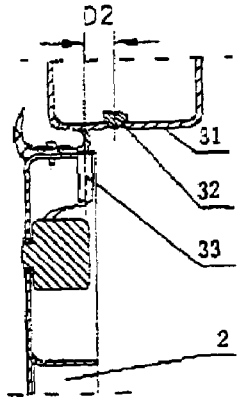
FIG. 17 is the structural representation of the door 2 in an open state relative to the doorcase 31 in FIG. 15.

According to FIGS. 15, 16 and 17, the electronic intelligent module also has a doorcase proximity switch 33 to detect illegally opening of the door. The doorcase proximity switch 33 is fixed on the upper flange of the top door beam 4. A doorcase proximity switch sensing element 32 is installed in an aperture in the doorcase 31 opposite to the location of the doorcase proximity switch 33 in the door. The doorcase proximity switch 33 is connected to the electronic intelligent module 9 via wiring 34. When the door is normally closed and the distance between the proximity switch 33 and the sensing element 32 is less than a particular value, the proximity switch 33 will enter into one state. When the distance is greater than a certain value, the switch 33 will enter into another state and output alarm signals. The doorcase proximity switch 33 can be one of capacitance type, induction type or magnetic reed type proximity switch.

The structures discussed above can be symmetrically interchanged between the right and the left doors of the container body.

From the ordinary technical skill in the art, it can be seen that this invention can be carried out by various methods without any substantive deviation from its inventive concepts. Therefore, the embodiments disclosed above are intended to be illustrative but not limiting. All the modifications and innovations within the scope of the invention or equivalent to the scope of the invention are considered to be encompassed by the invention.

What is claimed is:

1. An intelligent transportation container having a container body with a pair of doors hingedly coupled thereto and each of the doors being secured in a closed position with a respective locking bar, said intelligent container comprising:

an electronic intelligent module mounted on an interior side of one of the pair of doors, said electronic intelligent module having a door displacement transducer coupled thereto that monitors displacement of the pair of doors and outputs signals responsive thereto, said electronic intelligent module including an antenna located in aligned relationship with an opening formed through the one door and extends through the opening to exit the container body for transmission of signals from said electronic intelligent module responsive to said signals output from said door displacement transducer.

2. The intelligent transportation container according to claim 1, wherein said door displacement transducer is mounted on the one door at a location adjacent to the other door.

3. The intelligent transportation container according to claim 1, wherein said door displacement transducer is a proximity switch, said proximity switch entering a first state when a distance between the pair of doors is less than a certain value, said proximity switch entering a second state and outputting a signal responsive to said distance between the pair of doors being greater than said certain value.

4. The intelligent transportation container according to claim 1, wherein said door displacement transducer is a position switch, said position switch having an inner contact that is open responsive to a distance between the pair of doors being less than a certain value, said inner contact being closed responsive to said distance being greater than said certain value and outputting a signal responsive thereto.

5. The intelligent transportation container according to claim 1, wherein said door displacement transducer is a pressure transducer, said pressure transducer entering a first state when said pressure transducer is impacted by a member coupled to one of the container body or the other door, said pressure transducer entering a second state and outputting a signal responsive to said member being displaced from said pressure transducer.

6. The intelligent transportation container according to claim 1, further comprising an antenna sealing ring disposed between an inside surface of the opening in the one door for the antenna and an external surface of said antenna.

7. The intelligent transportation container according to claim 1, further comprising a locking bar transducer mounted to the interior side of the one door and coupled to said electronic intelligent module, and a locking bar sensed element mounted on a surface of a corresponding locking bar for rotation therewith, said locking bar sensed element being coupled to a portion of the corresponding locking bar concealed behind a bracket supporting the locking bar, at least a portion of the locking bar transducer passing through an aperture in the one door, said sensed element being displaced from the locking bar transducer when the one door is closed, said sensed element passing in proximity of said locking bar transducer responsive to rotation of the corresponding locking bar, the locking bar transducer outputting signals responsive to said sensed element being passed in proximity thereto.

8. The intelligent transportation container according to claim 7, wherein said locking bar transducer is a proximity switch.

9. The intelligent transportation container according to claim 7, wherein said locking bar transducer is a position switch.

10. The intelligent transportation container according to claim 7, wherein said locking bar transducer is a pressure transducer, said pressure transducer includes a contactor pressed by said locking bar sensed element when a distance between said pressure transducer and the locking bar sensed element is less than a certain value, said contactor being separated from said locking bar sensed element when said distance is greater than said certain value.

11. The intelligent transportation container according to claim 7, further comprising a transducer sealing ring disposed between an inside surface of the aperture in the one door and an external surface of said at least a portion of said locking bar transducer.

12. The intelligent transportation container according to claim 1, further comprising a danger sensitive module mounted adjacent said electronic intelligent module for detecting whether a dangerous material has been loaded into the container body.

13. The intelligent transportation container according to claim 12, wherein said electronic intelligent module and said danger sensitive module are secured to the one door with hat-shaped mounting plates.

14. The intelligent transportation container according to claim 1, further comprising a doorcase proximity switch mounted in a top portion of the one door and a doorcase proximity switch sensed element mounted to a doorcase of the container body at a location corresponding to said doorcase proximity switch, said doorcase proximity switch being connected to said electronic intelligent module via wiring, said doorcase proximity switch being in a first state when the one door is closed and thereby a distance between the doorcase proximity switch and the doorcase proximity switch sensed element is less than a certain value, said doorcase proximity switch entering a second state responsive to the one door opening and thereby said distance is greater than said certain value and outputting a signal responsive thereto.

15. The intelligent transportation container according to claim 14, wherein said doorcase proximity switch is one of a capacitance type proximity switch, or an induction type proximity switch, or a magnetic reed type proximity switch.

* * * * *